US008240147B2

(12) United States Patent
Taba

(10) Patent No.: US 8,240,147 B2
(45) Date of Patent: Aug. 14, 2012

(54) ROTARY ENERGY CONVERSION DEVICE WITH RECIPROCATING PISTONS

(76) Inventor: Anthony Taba, McGregor (CA)

( * ) Notice: Subject to any disclaimer, the term of this patent is extended or adjusted under 35 U.S.C. 154(b) by 615 days.

(21) Appl. No.: 12/467,030

(22) Filed: May 15, 2009

(65) Prior Publication Data

US 2010/0192565 A1 Aug. 5, 2010

Related U.S. Application Data

(60) Provisional application No. 61/148,915, filed on Jan. 30, 2009.

(51) Int. Cl.

| | |
|---|---|
| ***F01B 29/08*** | (2006.01) |
| ***F01B 13/04*** | (2006.01) |
| ***F01K 25/00*** | (2006.01) |
| ***F02G 1/04*** | (2006.01) |
| ***F02B 75/26*** | (2006.01) |
| ***F02B 57/08*** | (2006.01) |

(52) U.S. Cl. ..... 60/516; 60/508; 60/519; 123/43 R; 123/44 R

(58) Field of Classification Search ..... 60/508–526; 123/43 R, 44 R, 45 R; 418/241, 259–269
See application file for complete search history.

(56) References Cited

U.S. PATENT DOCUMENTS

| | | | | |
|---|---|---|---|---|
| 2,513,692 | A * | 7/1950 | Tubbs | 60/531 |
| 3,157,024 | A * | 11/1964 | Wilkinson et al. | 60/525 |
| 5,325,671 | A * | 7/1994 | Boehling | 60/682 |

* cited by examiner

*Primary Examiner* — Thomas Denion
*Assistant Examiner* — Christopher Jetton
(74) *Attorney, Agent, or Firm* — Daryl W. Schnurr

(57) ABSTRACT

A rotary heat engine has a cylindrical engine block containing a rotor with four equally spaced pistons and corresponding cylinders extending radially in the rotor. The pistons are pivotally connected to connecting rods that are in turn connected to a shaft at an inner end of each connecting rod. The engine block has a cover thereon and the block can have heating and cooling locations that create heating and cooling chambers within the rotor, thereby causing the pistons to reciprocate and causing the rotor to rotate within the engine block. The pistons reciprocate within the rotor while the rotor rotates within the engine block.

27 Claims, 15 Drawing Sheets

ROTARY ENERGY CONVERSION DEVICE WITH RECIPROCATING PISTONS

Application claims the benefit of U.S. Provisional Application Ser. No. 61/148,915 filed Jan. 30, 2009.

BACKGROUND OF THE INVENTION

1. Field of the Invention

This invention relates to a rotary energy conversion device with reciprocating pistons located within a rotor that rotates within a cylindrical block. This invention relates to a rotary heat engine with reciprocating pistons located within a rotor that rotates within an engine block. The pistons are located in corresponding cylinders that extend radially within the rotor. The invention further relates to a pneumatic engine. The invention still further relates to a heat pump for heating and cooling.

2. Description of the Prior Art

Heat engines and rotary heat engines are known.

The Takei et al U.S. Pat. No. 4,578,949 describes a hot gas reciprocating apparatus and convector heater. The reciprocating apparatus has a displacer piston and a power piston that reciprocate within a cylinder. The apparatus is not a rotary engine. The Wahnschaffe et al U.S. Pat. No. 3,800,526 describes a hot gas engine constructed as a rotary piston engine. The engine has one piston 3 that rotates in a clockwise direction. The piston 3 does not reciprocate and has a polygonal shape.

SUMMARY OF THE INVENTION

It is an object of the present invention to provide a rotary heat engine with an engine block that has fixed heating or cooling locations. It is an object of the present invention to provide a rotary heat engine with reciprocating pistons located within a rotor that is in turn rotatably mounted within an engine block.

A rotary heat engine comprises a cylindrical engine block having a longitudinal centre axis and containing a rotor having a plurality of equally spaced pistons and corresponding cylinders extending radially therein. The pistons are pivotally connected to connecting rods that are in turn pivotally connected to a shaft at an inner end of each connecting rod. This shaft extends through the engine block in a direction substantially parallel to the longitudinal centre axis of the block. The block contains a slot to allow the shaft to move laterally toward or away from the centre axis. The rotor is sized and shaped to rotate within the engine block in a plane perpendicular to the centre axis. The rotor has a plurality of heating and cooling chambers therein, there being one heating and cooling chamber for each piston. The heating and cooling chambers each include one of the corresponding cylinders, the pistons and corresponding cylinders each being shaped so that the pistons slide radially within the cylinders. The engine block is heated at one or more locations and cooled at one or more alternate locations around a circumference of the block. The heated or cooled locations of the engine block cause heating or cooling of the chambers respectively within the rotor. The rotor contains a working fluid within the chambers, the pistons moving inward in response to a heated chamber and outward in response to a cooled chamber, a reciprocating movement of the pistons in succession causing the rotor to rotate within the block. The pistons and the chambers rotate with the rotor.

Preferably, the shaft does not rotate and energy is produced by the engine through the rotation of the rotor, which rotates about the shaft.

A heat pump for heating or cooling comprises a cylindrical engine block having a longitudinal centre axis and containing a rotor having a plurality of equally spaced pistons and corresponding cylinders extending radially within the rotor. The pistons are pivotally connected to connecting rods which are in turn pivotally connected to a shaft at an inner end that is the connecting rod. The shaft extends through the engine block in a direction substantially parallel to the centre axis. The engine block contains a slot to the left of the shaft to move laterally toward or away from the centre axis. The rotor is sized and shaped to rotate within the engine block in a plane perpendicular to the centre axis. The rotor has a paralety of heating and cooling chambers therein, there being one heating and cooling chamber for each piston. The heating and cooling chambers each include one of the corresponding cylinders, the pistons and the corresponding cylinders each being shaped so that the pistons slide radially within the cylinders. The rotor is connected to an energy source to cause the rotor to rotate within the engine block. The rotation of the rotor in a clockwise direction causes a vacuum in a lower portion of the engine block and compression in an upper portion of the engine block, thereby cooling the lower portion and heating the upper portion. The pistons reciprocate as the rotor rotates within the engine block.

A pneumatic engine comprises a rotor having a plurality of equally spaced pistons in corresponding cylinders extending radially therein. The pistons are pivotally connected to connecting rods that are in turn pivotally connected to a shaft at an inner end of each connecting rod. The shaft extends through the engine block in a direction substantially parallel to the center axis. The block contains a slot toward or away the center axis. The rotor is sized and shaped to rotate within the engine block in a plane perpendicular to the center axis. The rotor has a plurality of chambers therein, there being one chamber for each piston. The chambers each include one of the corresponding cylinders, the pistons in the corresponding cylinders each being shaped so that the pistons slide radially within the cylinders. The engine block has a plurality of inlet ports on one side thereof and a plurality of outlet ports in an opposite side thereof. The inlet ports are connected to allow high pressure fluid to enter those of the chambers that are adjacent to the inlet ports. The outlet ports are connected to exhaust the fluid from those of the chambers located adjacent to the outlet ports. The pistons move inward in response to the high pressure fluid entering the chambers through the inlet ports and the pistons move outward in response to the fluid being exhausted from the outlet ports. A reciprocating movement of the pistons in succession in response to the high pressure fluid moving through the chambers of the engine block causes the rotor to rotate within the block, the pistons and chambers rotating with the rotor. The block has a longitudinal center axis and contains a rotor having a plurality of equally spaced pistons and corresponding cylinders extending radially therein. The pistons are pivotally connected to connecting rods that are in turn connected to a shaft at an inner end of each connecting rod. The shaft extends through the block in a direction substantially parallel to the center axis. The block contains a slot to allow the shaft to move laterally toward or away from the center axis. The rotor is sized and shaped to rotate within the block in a plane perpendicular to the center axis, the rotor having a plurality of chambers therein. There is one chamber for each piston, the chambers each including one of the corresponding cylinders. The pistons and corresponding cylinders are each shaped so that the pistons slide radially within the cylinders. The block is subjected to an energy input on one side of the block and an energy output on an opposite side of the block. The energy input enters the chambers that are located adjacent to the energy input side of the block and cause the pistons in those chambers to move inward in response to the energy input and causes the pistons in the chambers on an opposite side of the block to move outward in response to energy output from the block. A reciprocating movement of the pistons in succession causes the rotor to rotate within the block, the pistons and the chambers rotating with the rotor.

DETAILED DESCRIPTION OF A PREFERRED EMBODIMENT

Figure 1:
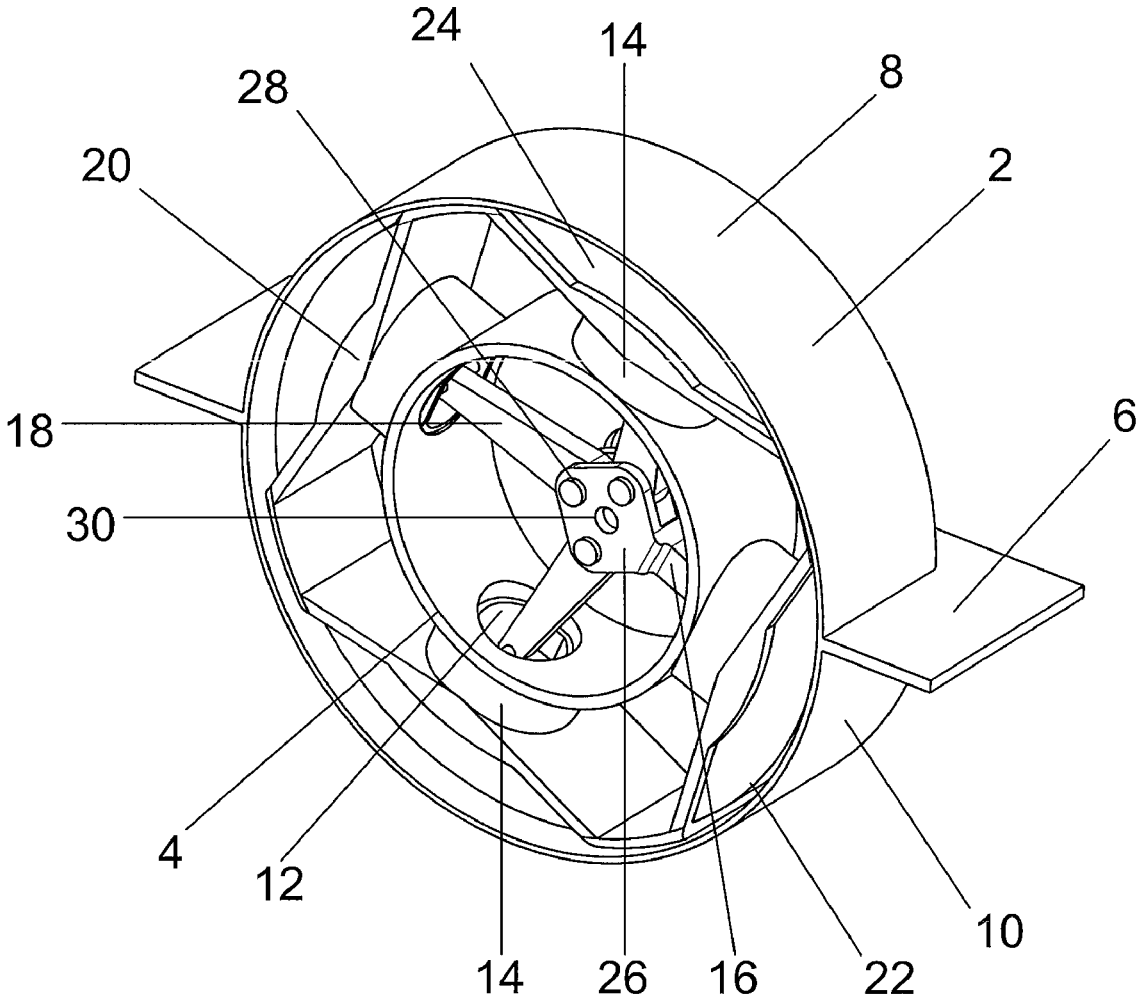
FIG. 1 is a perspective view of a rotor mounted in an engine block.

FIG. 1, an engine block 2 contains a rotor 4. A layer of insulation 6 separates an upper half 8 of the engine block from a lower half 10. The lower half 10 is heated and the upper half 8 is cooled. The rotor 4 is sized and shaped to rotatably fit within the engine block 2 and has four pistons 12 (only two of which are shown), with each piston being slidably mounted in a cylinder 14. There is a master connecting rod 16 and three slave connecting rods 18. The slave connecting rods 18 are pivotally connected to the master connecting rod 16 and each connecting rod is pivotally connected to one of the pistons 12. Around each of the cylinders 14, there is located a partition wall 20. The partition wall and other components (eg. the pistons) may incorporate seals (not shown). The partition wall 20 for each cylinder 14 defines a heating and cooling chamber 22 that is bounded by part of the inner surface of the engine block 2, the partition wall 20 and that part of each cylinder 14 on the outer end of each piston 12. Within each heating and cooling chamber 22, there is located a pocket 24. The slave connecting rods are pivotally connected to a bracket 26 of the master connecting rod 16 by pivot pins 28. An opening 30 in a centre of the bracket 26 is sized and located to receive a rotatable shaft (not shown in FIG. 1). A cover for the engine block 2 has been omitted to expose an interior.

Figure 2:
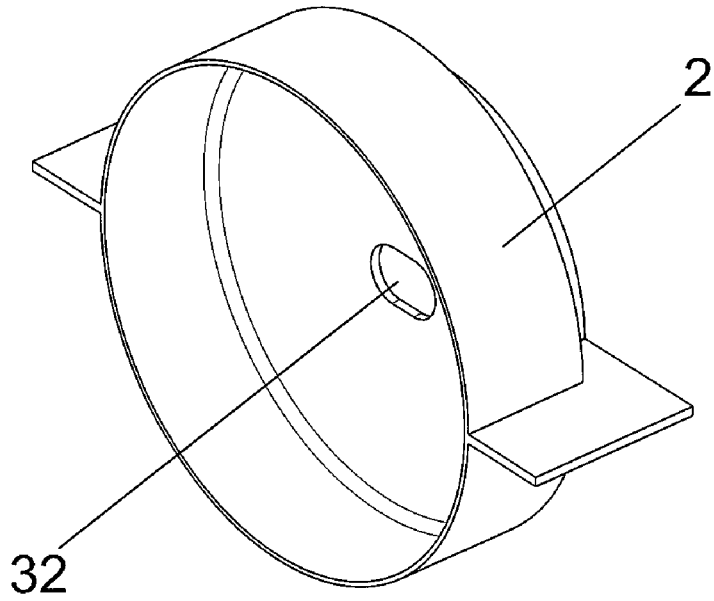
FIG. 2 is a perspective view of the engine block when viewed from inside.
Figure 3:
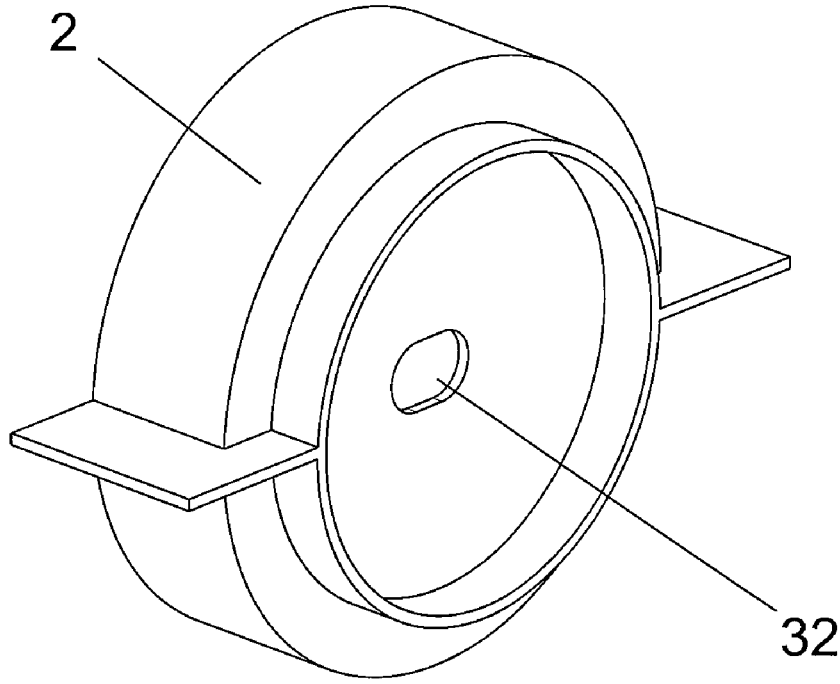
FIG. 3 is a perspective view of the engine block when viewed from outside.

In FIGS. 2 and 3, there are shown inside and outside perspective views respectively of the engine block 2. An oblong slot 32 is centered substantially along a longitudinal centre axis of the cylindrical engine block.

Figure 4:
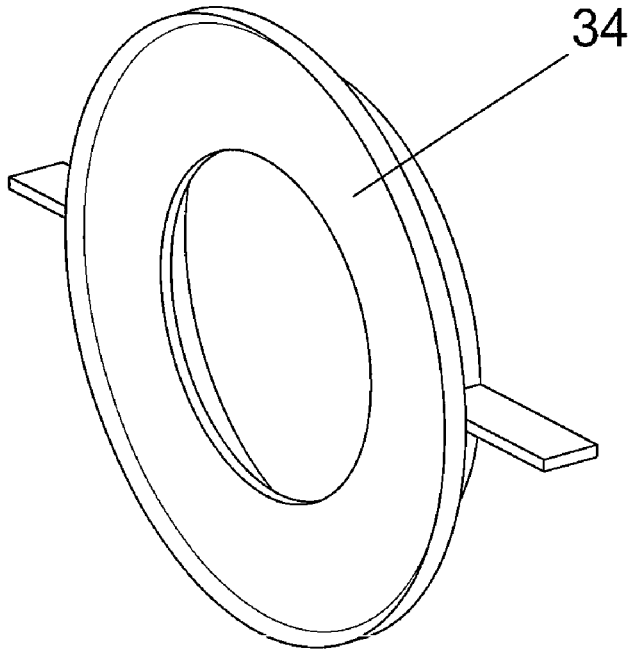
FIG. 4 is a perspective view of a cover for the engine block when viewed from insider.
Figure 5:
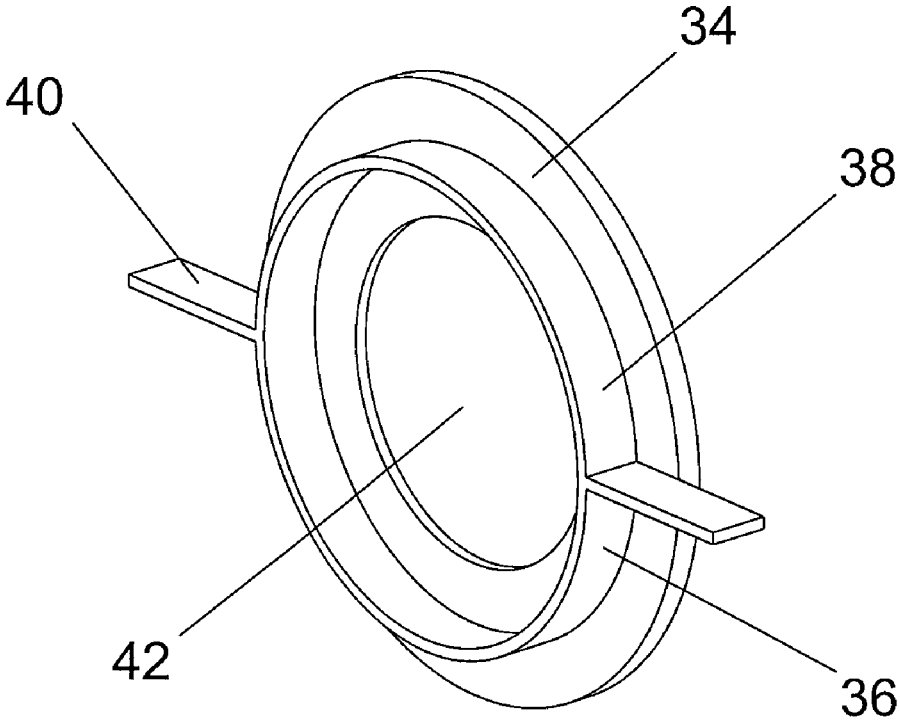
FIG. 5 is a perspective view of the cover when viewed from outside.
Figure 6:
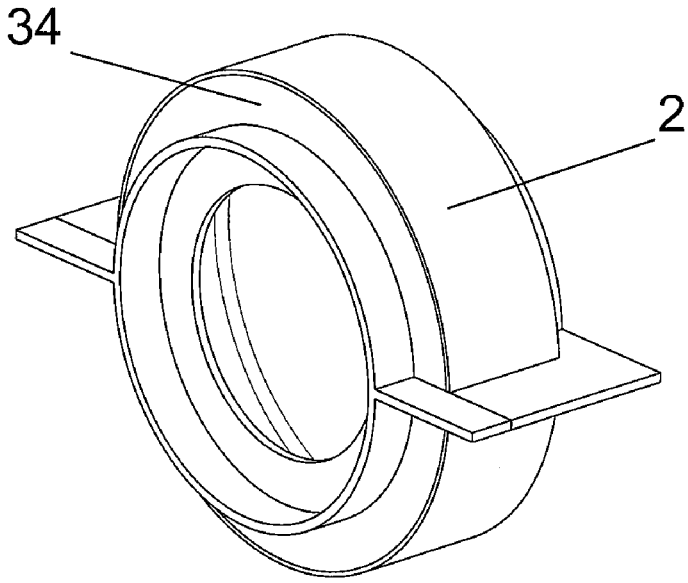
FIG. 6 is a perspective view of a cover on the block.
Figure 7:
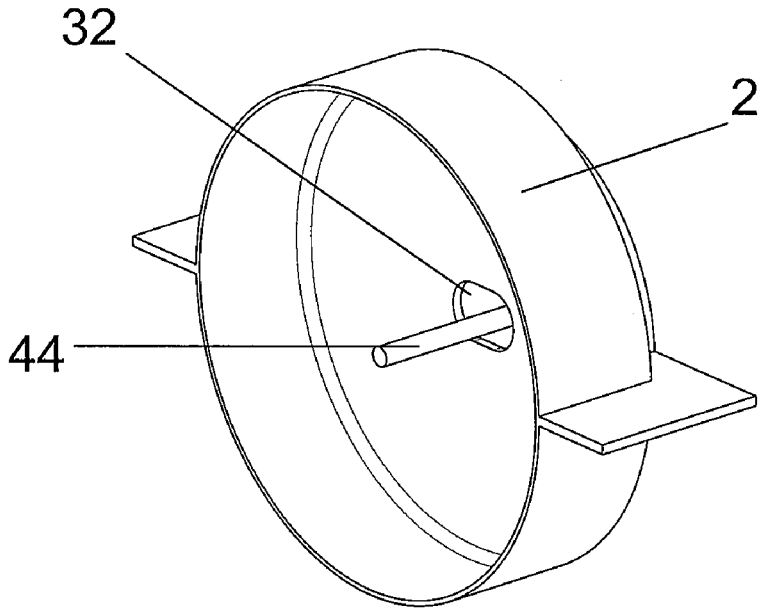
FIG. 7 is a perspective view of the engine block with a rotatable shaft extending through a slot therein.
Figure 8:
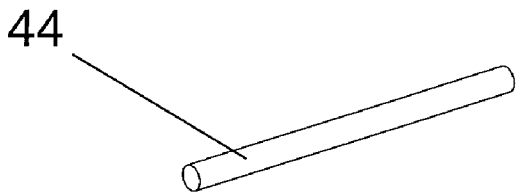
FIG. 8 is a perspective view of part of the rotatable shaft.

In FIGS. 4 and 5, there is shown a perspective view of an inside and an outside of a cover 34 respectively. A lower half 36 of the cover 34 is heated and an upper half 38 is cooled. An insulation layer 40 separates the top half from the bottom half. There is an opening 42 in the centre of the cover 34 for the rotatable shaft (not shown in FIGS. 4 and 5). FIG. 6 is a perspective view of the engine block 2 and cover 34 with the cylinder omitted. FIG. 7 is a perspective view of the engine block 2 with a shaft 44 extending through the slot 32. FIG. 8 is a perspective view of part of the shaft 44. The shaft 44 is preferably not rotatable and the master connecting rod 16 has bearings (not shown) or a suitable lubricant or other means to enable the rotor and connecting rods to rotate about the non-rotatable shaft, which is only permitted to move laterally within the slot. The shaft provides a guide for inner ends of the connecting rods 16, 18 as the rotor rotates about the shaft. The energy produced by the rotor rotating within the engine block is harnessed. Alternatively, the master connecting rod 16 can be rigidly fixed to the shaft 44 and the shaft 44 can be supported by bearing located outside of the engine block and the shaft can be rigidly connected to the master connecting rod 16. As the master connecting rod and the three slave connecting rods rotate, the shaft 44 also rotates and energy produced by the rotating shaft can be harnessed to utilize the energy output from the engine. The engine block 2 can be open in a central area of a back (where the slot 32 is shown) in a manner that is similar to the opening 42 in the cover 34. In this embodiment (not shown), the slot would be eliminated.

Figure 9:
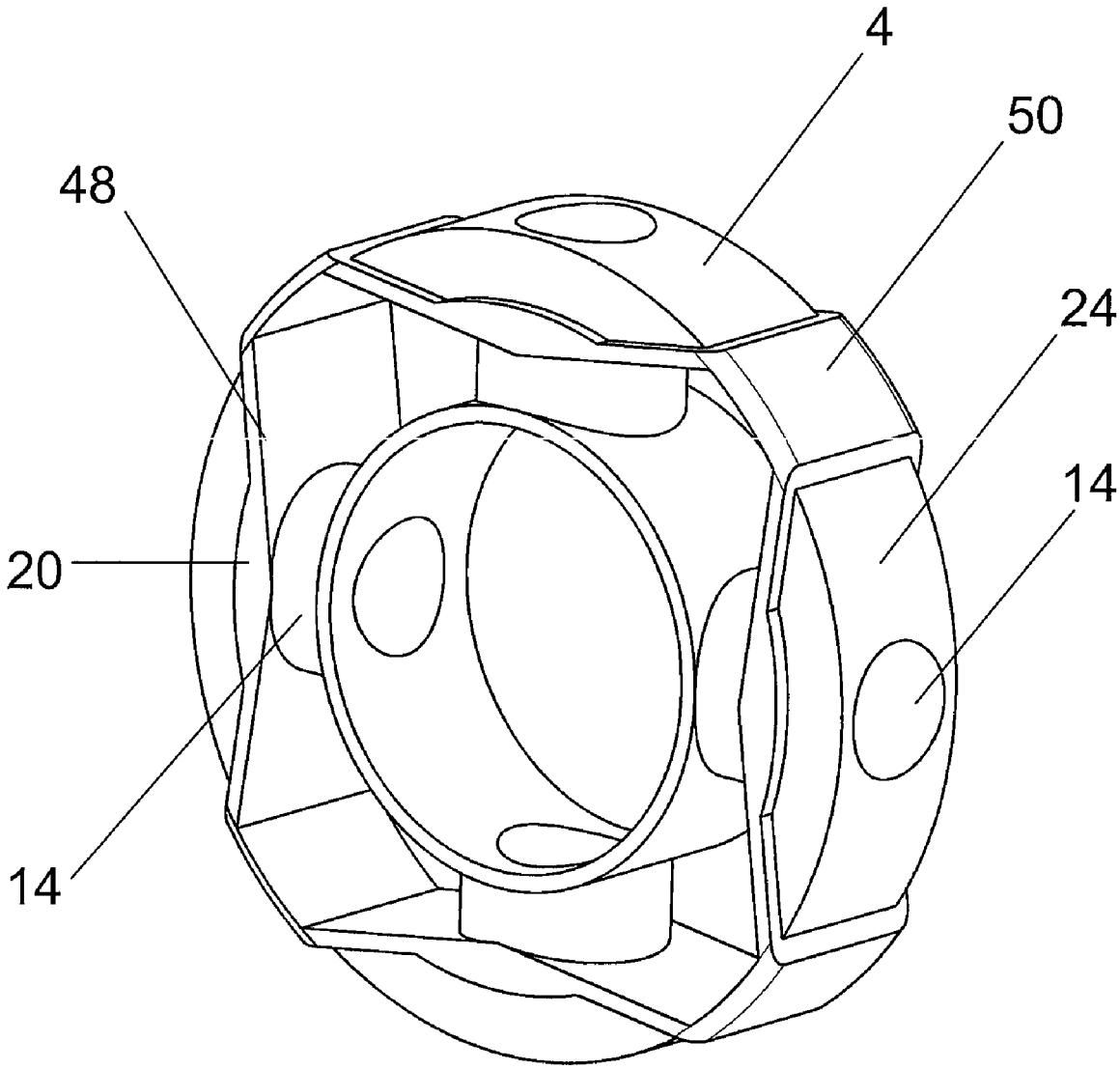
FIG. 9 is a perspective view of the rotor.

FIG. 9 is a perspective view of the rotor 4, with the pistons removed. The rotor 4 has an outer wall 48 with partition walls 20. It can be seen that each partition wall is an inwardly curved section 20 at each cylinder 14 and a pad 50 at a periphery of the rotor 4 between each of the cylinders 14. The four pads 50 are insulated to reduce or eliminate flow of heat or cold between adjacent cylinders 14. The pads 50 slide along an inner surface of the engine block 2 with contact with that inner surface as the rotor rotates during operation of the heat engine (not shown in FIG. 9). The pockets 24 are added to each of the inwardly curved sections to reduce the volume of the heating and cooling chamber that includes part of the cylinder 14 on the outside of the piston (not shown in FIG. 9)

and the space between the outer surface of each of the pockets 24 and the inner surface of the engine block 2 (not shown in FIG. 9).

Figure 10:
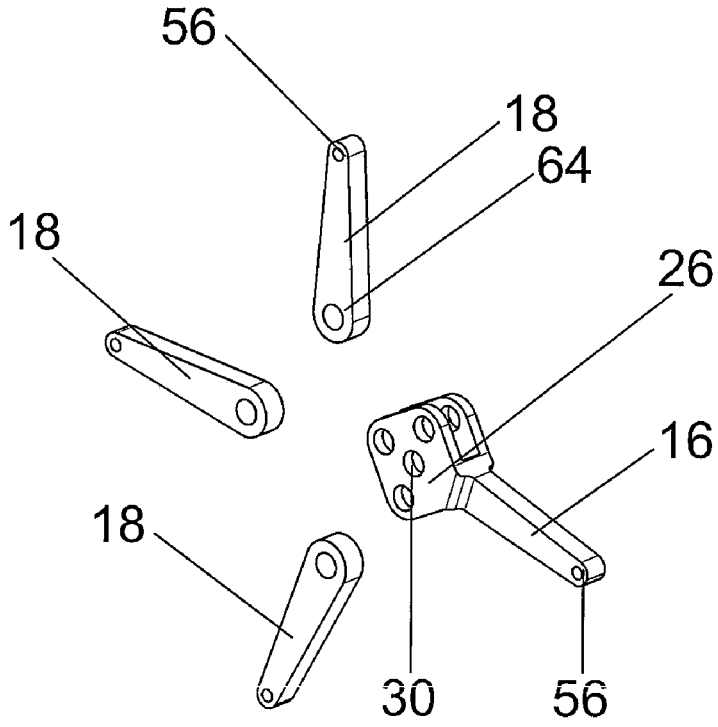
FIG. 10 is an exploded perspective view of connecting rods.
Figure 11:
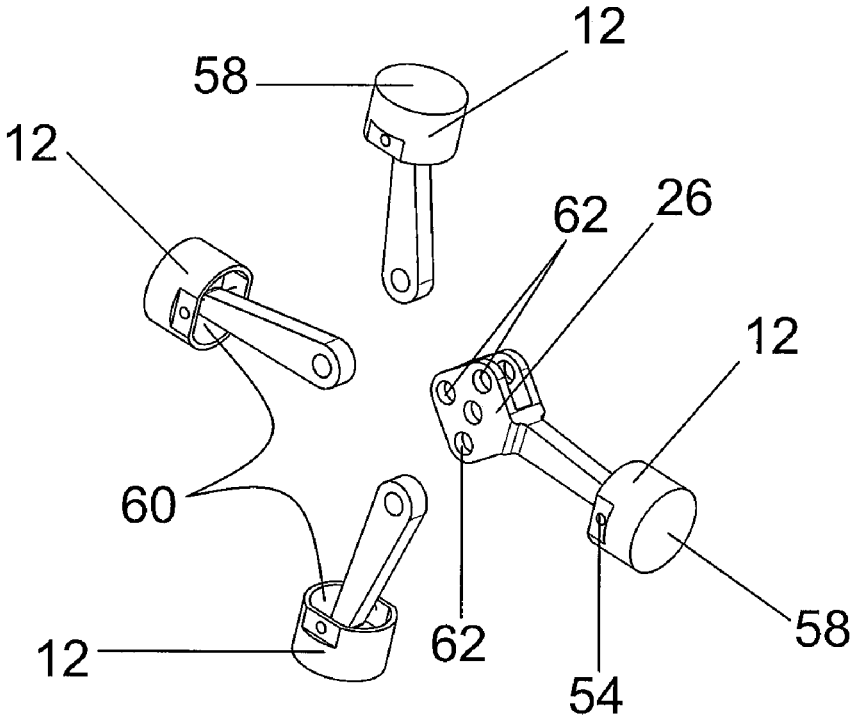
FIG. 11 is an exploded view perspective view of the connecting rods with pistons thereon.

FIG. 10 is an exploded view of the master connecting rod 16 with the bracket 26 that is integral therewith and the three slave connecting rods 18. FIG. 11 is an exploded view of the connecting rods 16, 18 with the pistons 12 pivotally connected thereto and held in place by a pin 54 that extends through an opening in each piston and a small opening 56 in an outer end in each connecting rods 16, 18 (see FIG. 10). An outer surface 58 of each of the pistons 12 is solid and an inner end 60 of each of the pistons is hollow. The outer surface 58 forms the innermost boundary, albeit a movable boundary, of the heating and cooling chambers (not shown in FIGS. 10 and 11) can be seen from FIGS. 10 and 11 that the bracket 26 has a double wall with identical openings 62 to receive the pin that extends through openings 64 at an inner end of the slave arms 18. The opening 30 is for the rotatable shaft (not shown in FIGS. 10 and 11). The pistons can have a piston ring (not shown) for sealing purposes.

Figure 12:
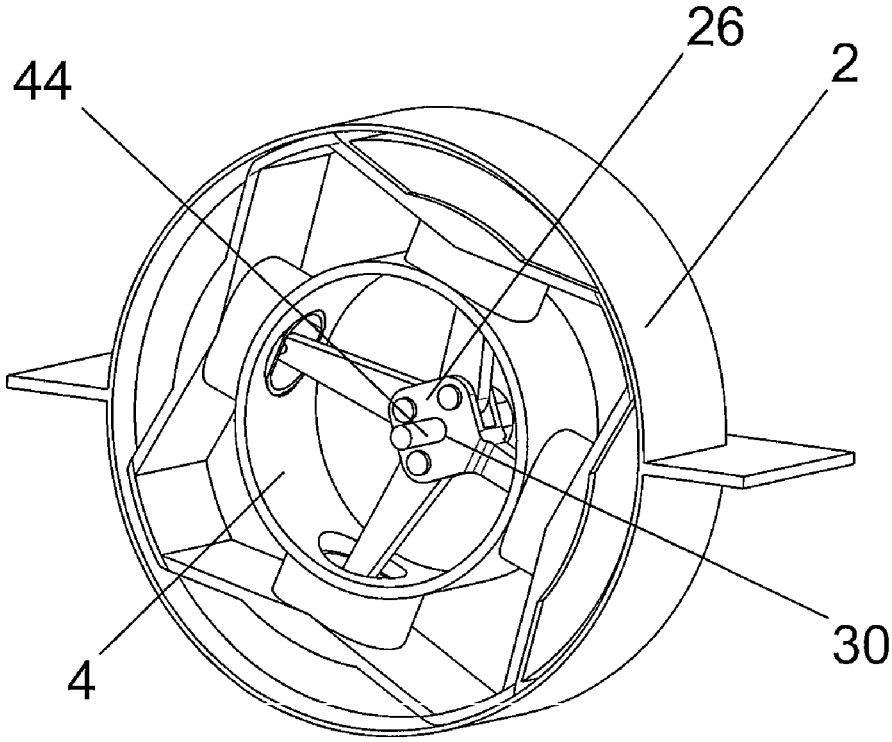
FIG. 12 is a perspective view of the connecting rods and pistons mounted in the rotor.
Figure 13:
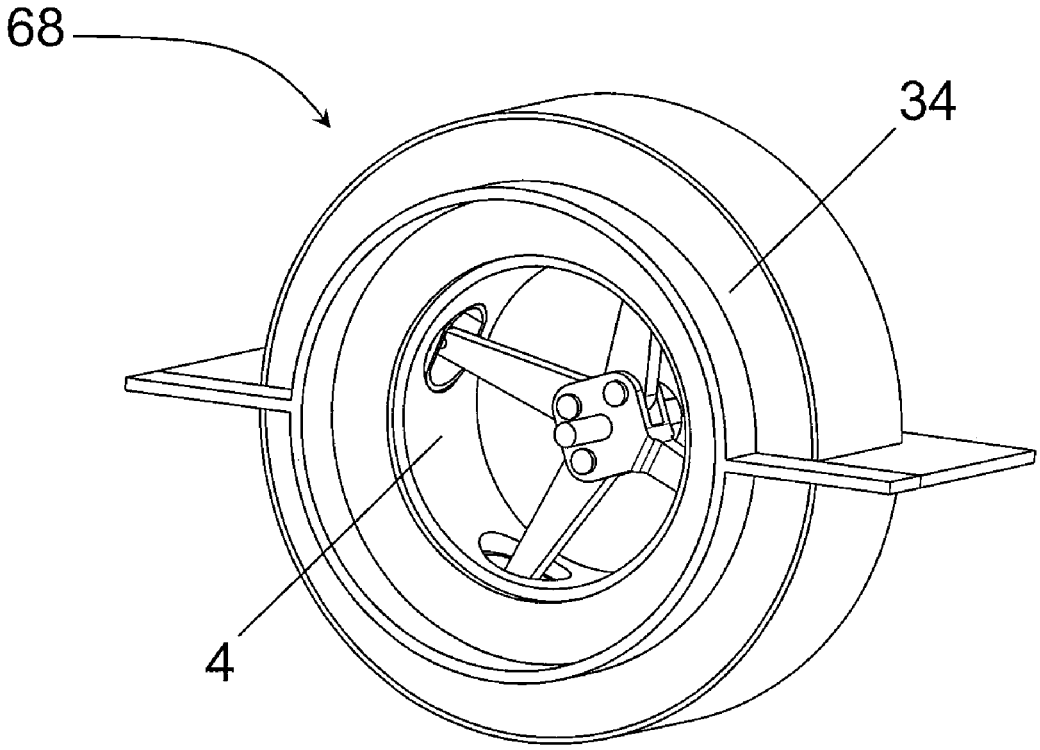
FIG. 13 is an assembled view of a heat engine.

FIG. 12 is the same as FIG. 1 except that a shaft 44 is located in the opening 30 of the bracket 26. FIG. 13 is a perspective view but is the same as FIG. 12 except that the cover 34 has been added to complete the heat engine 68.

Figure 14:
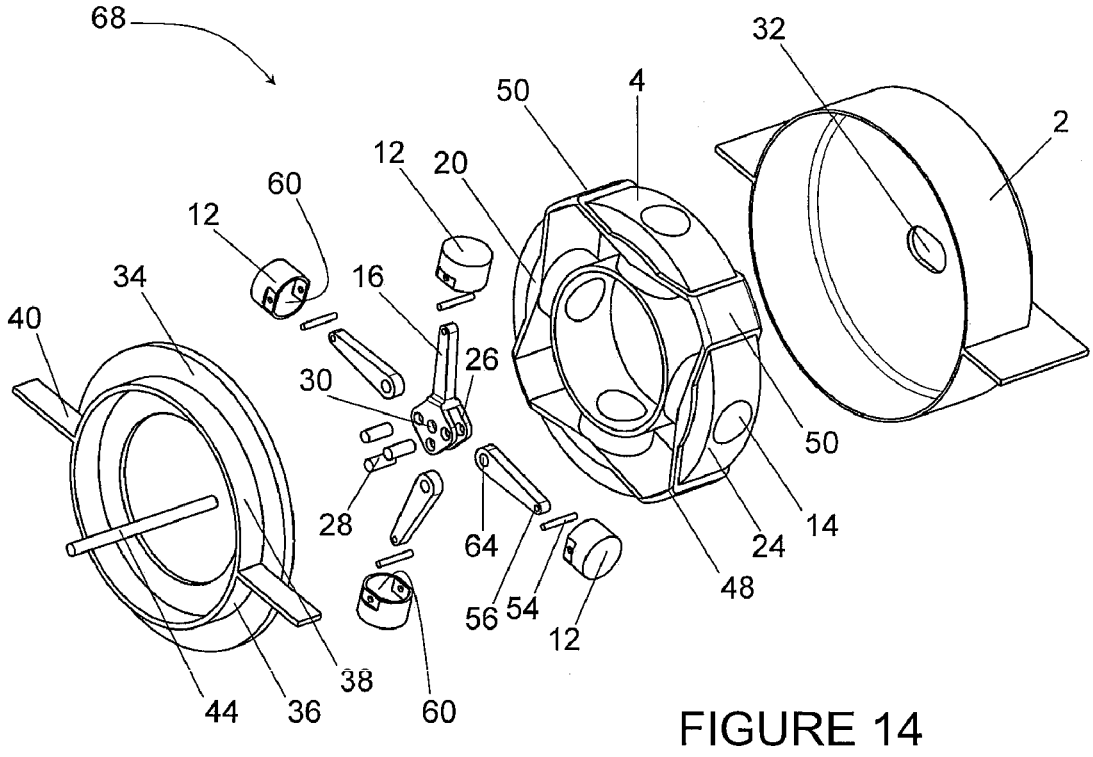
FIG. 14 is an exploded perspective view of the heat engine from outside the cover.
Figure 15:
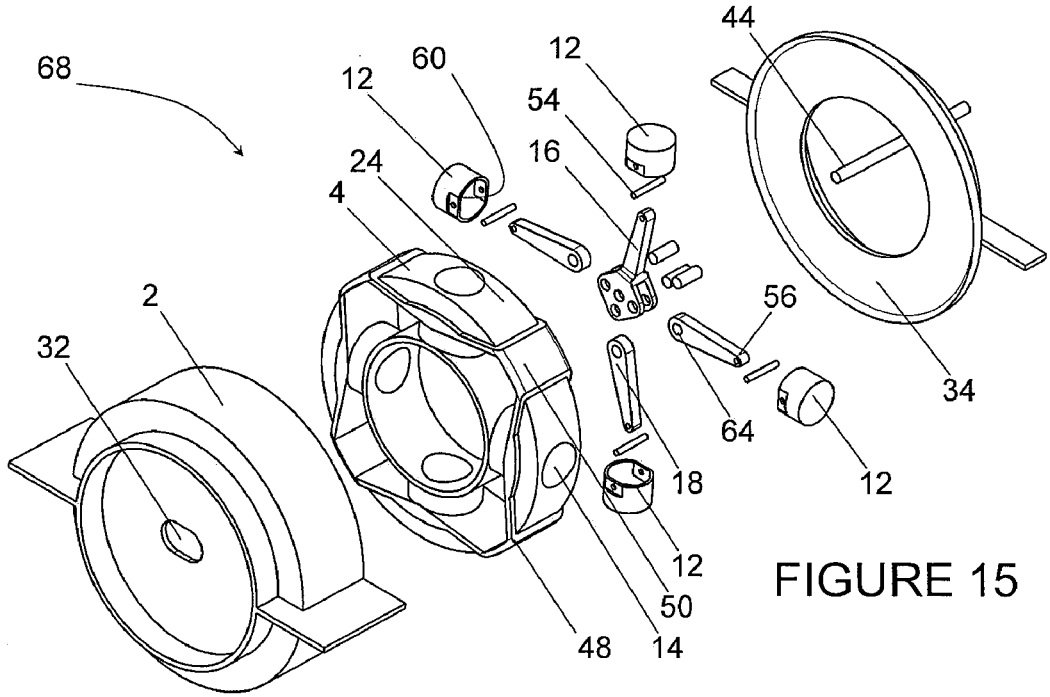
FIG. 15 is an exploded view of the heat engine from outside the engine block.

FIGS. 14 and 15 are front and rear exploded views of the heat engine 68. The same reference numerals are used in FIGS. 14 and 15 as those used in FIGS. 1 to 13 for those components that are identical. The shaft 44 is able to shift back and forth within the slot 32 in response to an external mechanism. At a centre of the slot, in the embodiment shown the shaft does not rotate and has zero torque. Torque increases at the shaft location moves laterally from the center. The rotor 4 is held in position within the engine block 2 either by contact between the pads 50 and the partition walls 20 of the rotor and the inner surfaces of the block 2 and cover 34 or by the shaft 44 or by both the inner surfaces of the block and the shaft 44. The floor pads 50 reduce or prevent heat transfer between the block and rotor as well as reducing or eliminating flow of heat or cold between adjacent cylinders 14.

Figure 16:
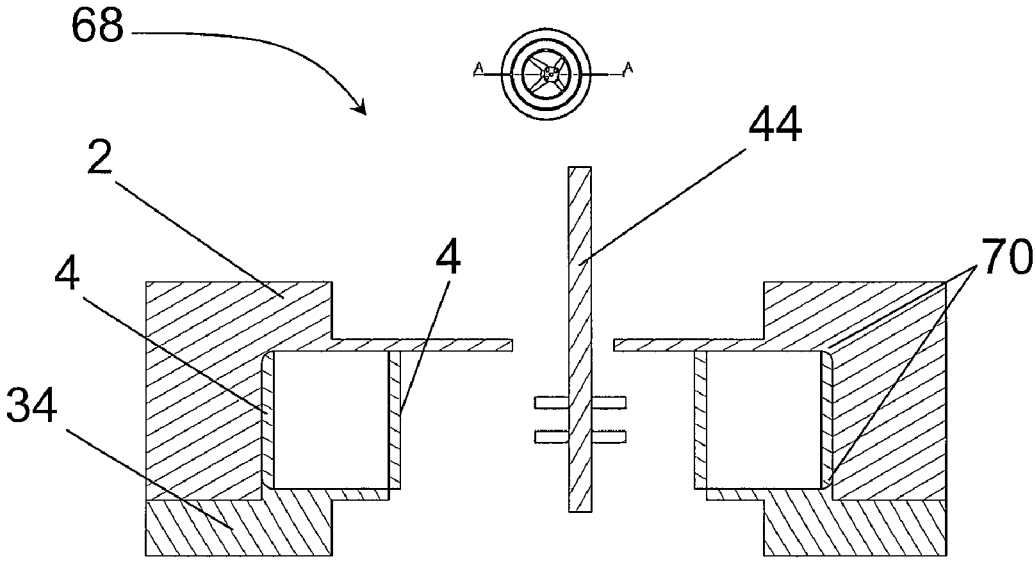
FIG. 16 is a sectional view of the engine between pistons.

In FIG. 16, there is shown a sectional view of the heat engine 68 through the pads 50 on opposing sides of the cylinder 4. The shaft 44 is at the right hand end of the slot 32. The pads 50 have rounded corners on outer edges 70 to conform with the adjacent corner of the engine block 2 and the cover.

Figure 17:
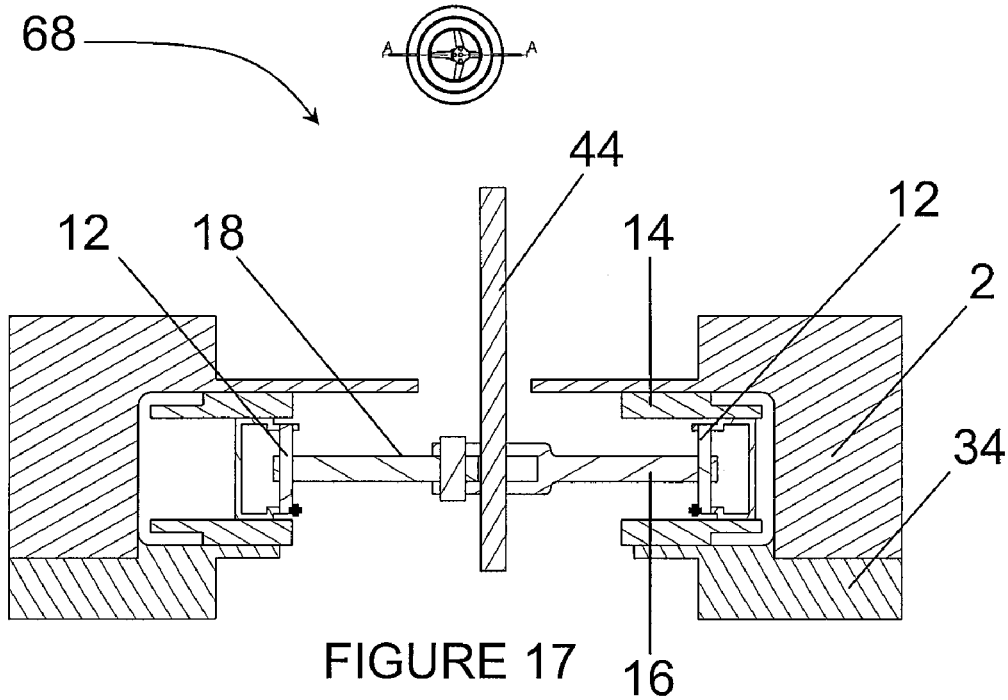
FIG. 17 is a sectional view of the engine through two of the pistons.

In FIG. 17, there is shown a sectional view of the engine 68 through the pistons 12. Again, the pivot shaft 44 is at the right hand side of the slot 32 and the piston on the right hand side is in the transition from cooling to heating or the fully compressed stage and the piston on the left is in the transition from heating to cooling or fully expanded phase.

Figure 18:
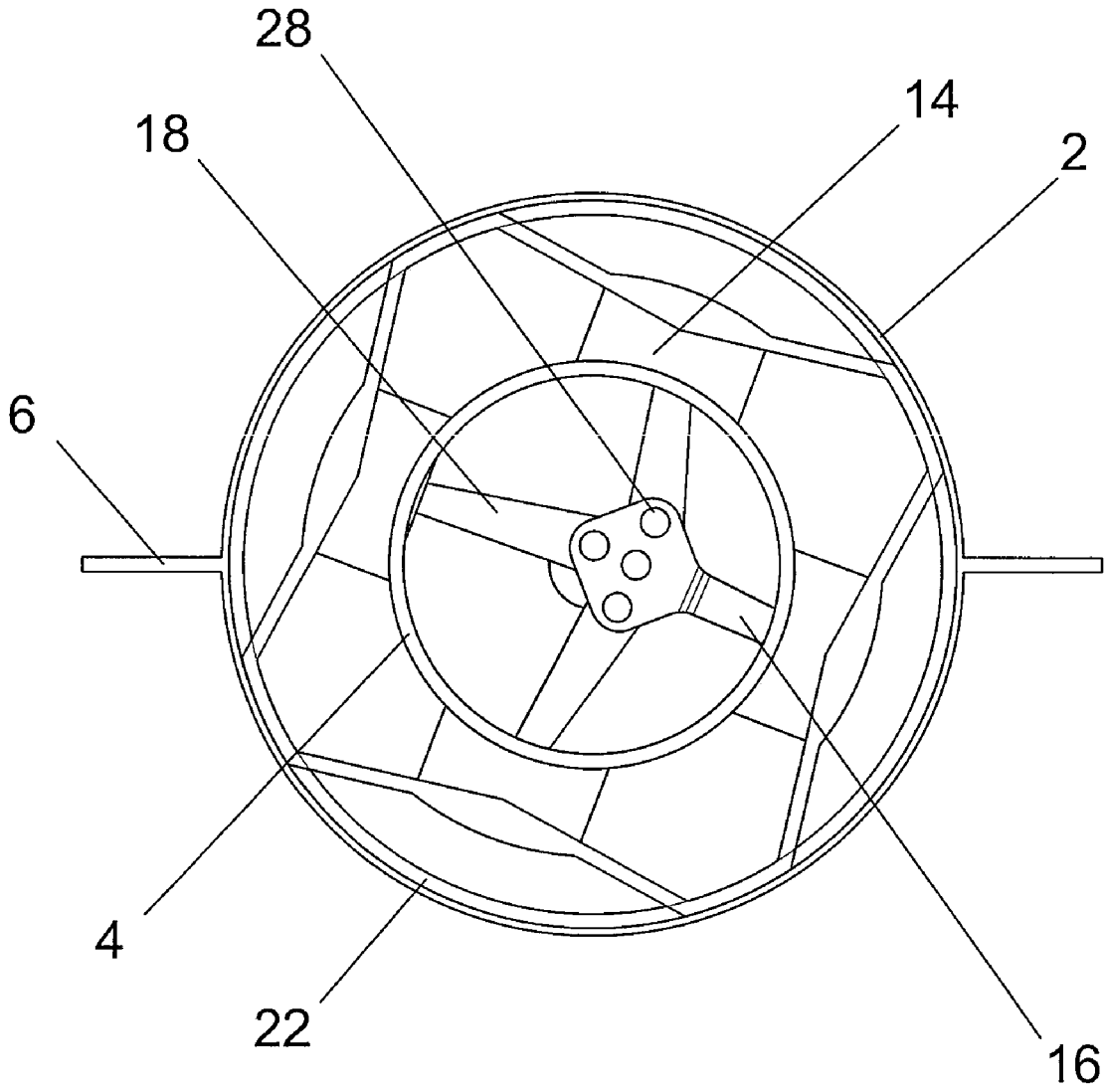
FIG. 18 is a side view of the engine block and rotor with the cover removed.

In FIG. 18, there is shown a front view of the engine block 2 containing the cylinder 4 with the cover removed. The same reference numerals are used in FIG. 18 as those used in FIGS. 1 to 17 for those components that are identical.

Figure 19:
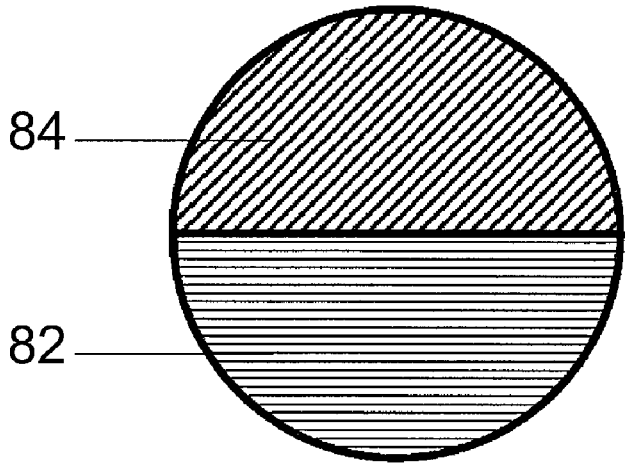
FIG. 19 is a schematic view of the heating and cooling portions of the block.
Figure 20:
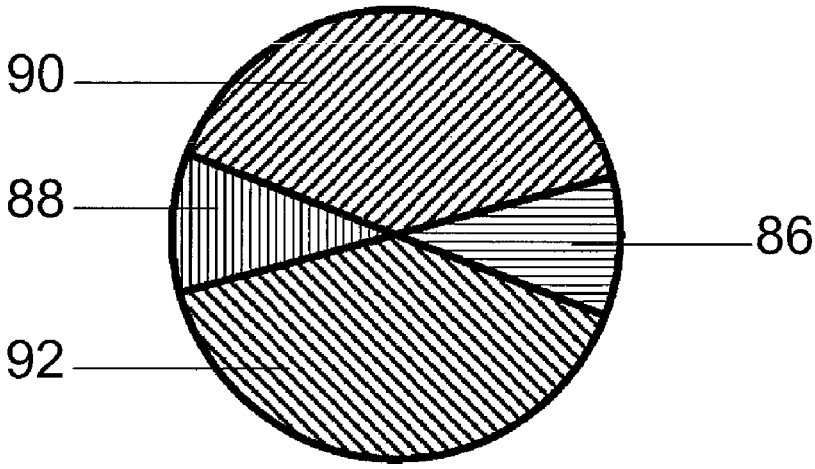
FIG. 20 is a further schematic view of the heating and cooling portions of the block.
Figure 21:
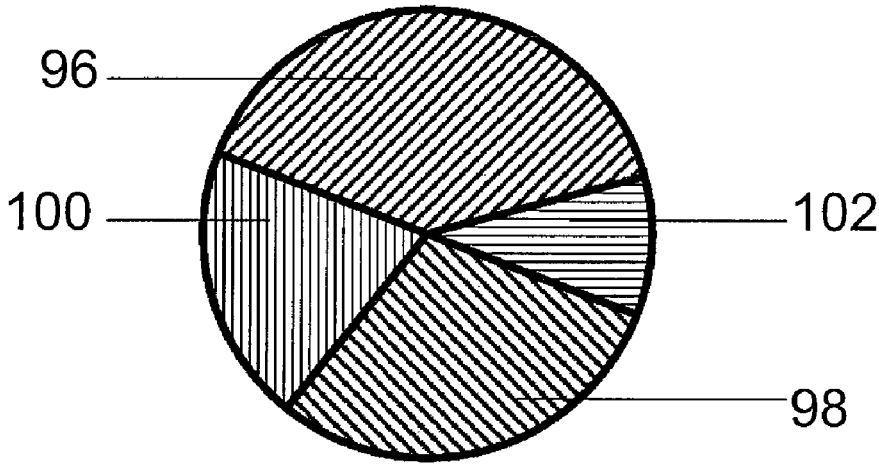
FIG. 21 is still a further schematic view of the heating and cooling portions of the block.

In FIGS. 19, 20 and 21, there is shown a series of schematic views of the heating and cooling zones of the engine block 2. FIG. 19, a lower half 82 of the engine block 2 is heated and is the heating zone and an upper half 84 is cooled and is the cooling zone. In FIG. 20, when a chamber is transitioning from the heated zone to the cooled zone, a particular chamber will be both heated and cooled. In FIG. 20, the two side portions 86, 88 in the areas of three o'clock and nine o'clock are insulated transition zones. The upper portion 90 and lower portion 92 are the cooling and heating zones respectively. In FIG. 21, it can be seen that a cooling zone 96 is larger than a heating zone 98 resulting in transition zones 100, 102 of different sizes. The heating portion of the cycle may require more or less time than the cooling portion of the cycle. Therefore changing the duration/position of a heated or cooled zone may increase the net heat transfer per cycle. Preferably, the engine block and cover are insulated between the heating and cooling zones.

An advantage of the present invention is that the heating and cooling zones of the block, once established, preferably remain fixed so that the heating zone is always in the same location and is always heated and the cooling zone is always in the same location and is always cooled. The engine proceeds through the cycles because the rotor rotates the cylinders through the zones. The chambers (pistons and cylinders) will be heated at one part of the cycle and cooled at another part of the cycle. The heat engine 68 has four pistons, corresponding cylinders and corresponding chambers. The cycle of each piston is cooling, compression, heating and expansion as the piston rotates 360 degrees around the engine block. Cooling and compression and heating and expansion occur at the same time for different pistons.

When the bottom of the engine block and cover are heated and the top is cooled, the gas in the chambers in the bottom half of the engine will expand, pushing the piston away from the outer surface of the block against the wall of the rotor. When the gas is fully expanded, the rotor is pushed in a clockwise direction in the view shown in FIG. 18. When the first cylinder rotates into the cooling zone of the engine block, the gas in the cooling chamber for that piston will begin to contract as will the first piston. However, the gas and the first piston will not be fully contracted until the first piston has moved entirely through the cooling zone. When the first piston on the top half of the engine is fully contracted, the opposing (third) piston on the bottom half of the engine will be fully extended. The remaining two pistons, (second and fourth) of the engine, that have recently entered the cooling and heating zones respectively will begin to contract and extend respectively. When the first piston rotates into the heating zone of the engine through further rotation of the rotor, the gas in the heating chamber for that piston will begin to expand. The gas in the first piston will fully expand and extend respectively when the first piston has moved entirely through the heating zone.

Figure 22:
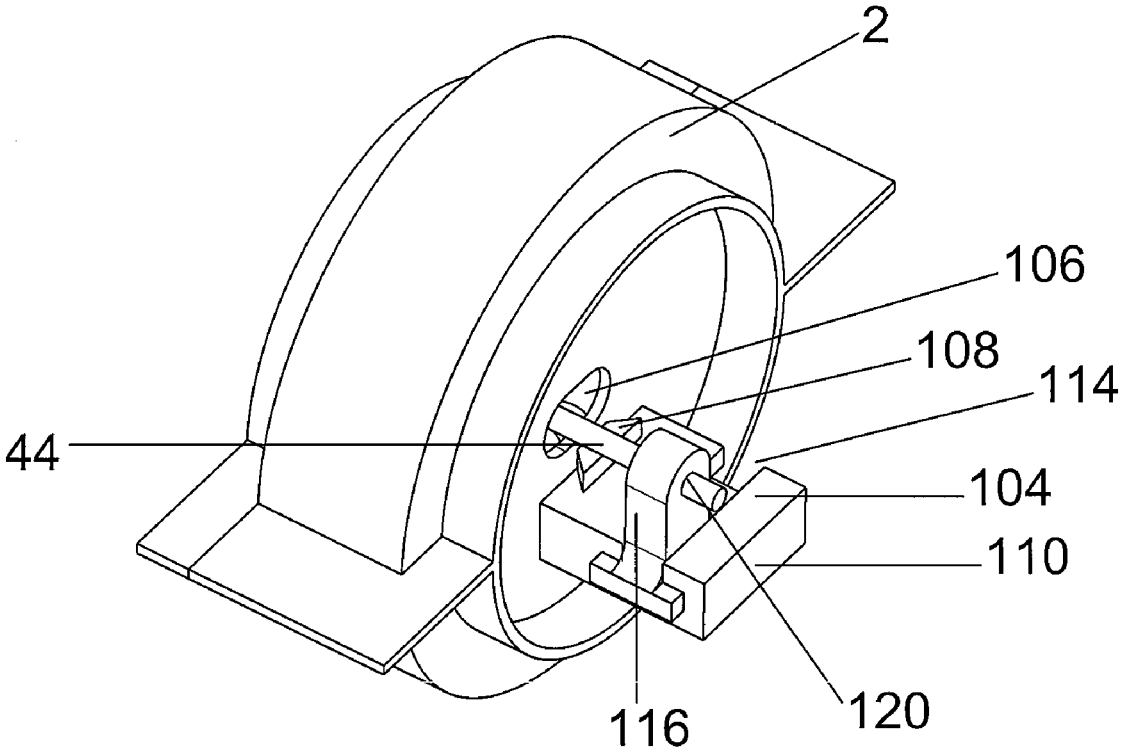
FIG. 22 is a perspective view of an external mechanism mounted on the block.
Figure 23:
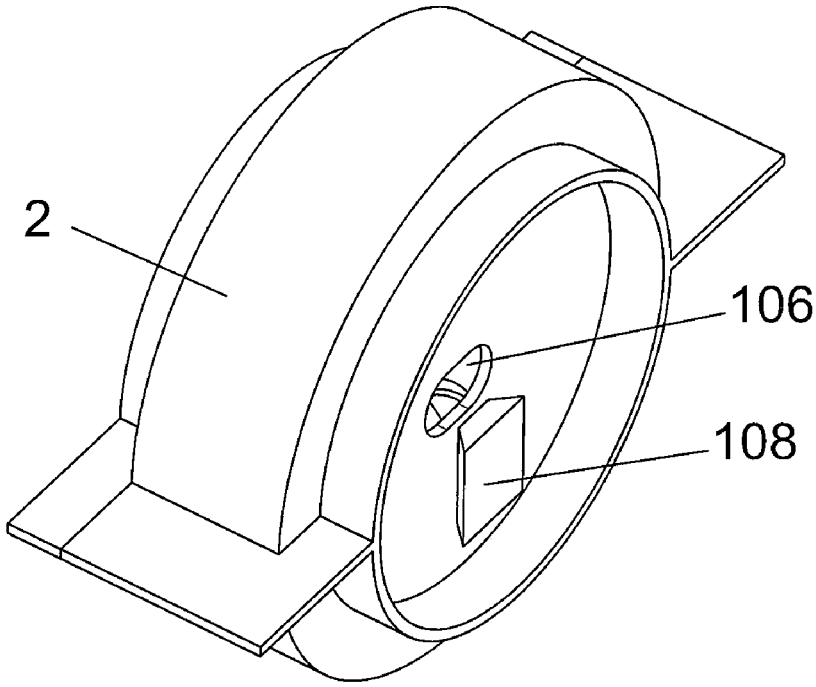
FIG. 23 is a perspective view of the engine block 2, having an anchor 108 mounted on an outer surface thereof.
Figure 24:
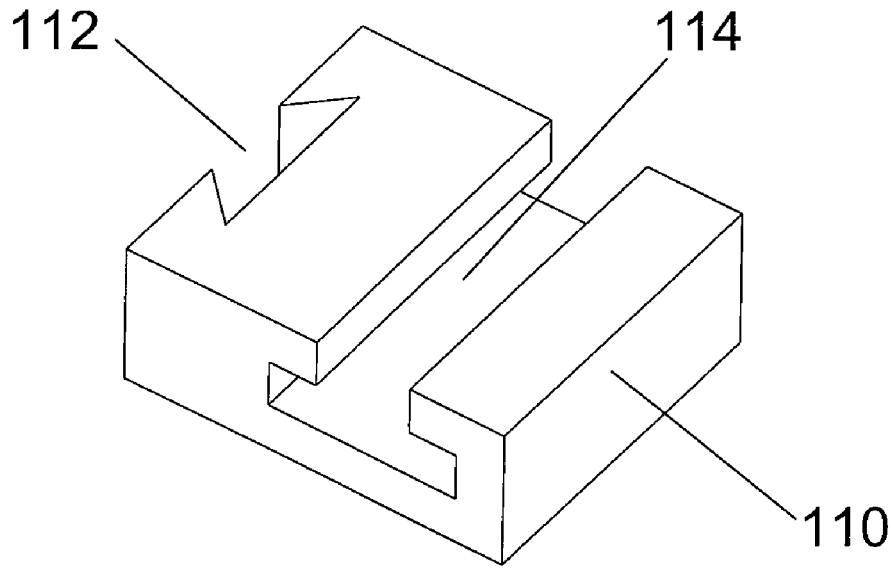
FIG. 24 is a perspective view of a base.
Figure 25:
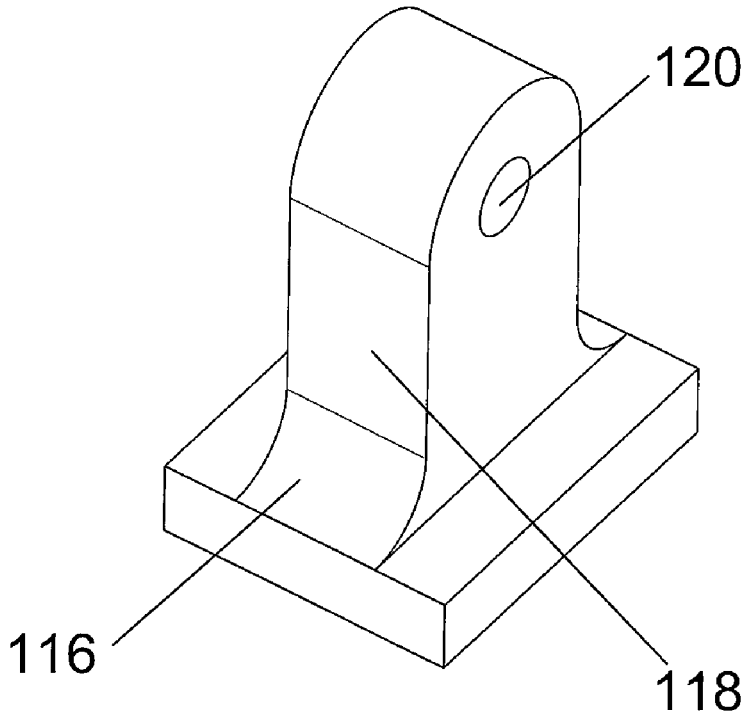
FIG. 25 is a perspective view of a guide.

In FIG. 22, there is shown a perspective view of an external mechanism 104, mounted on an outside of the engine block 2 to guide the shaft 44 in a vertical and horizontal direction. FIGS. 23 to 25 describe further components of the external mechanism 104. A slot 106 has been enlarged over the embodiment shown in FIGS. 1 to 18, but the slot 106 still has an oblong shaft. A dovetail shaped anchor 108 is mounted on an outer wall of the block 2. The anchor 108 is best shown in FIG. 23. A base 110 is slidably mounted on the anchor 108. The base 110 is best seen in FIG. 24 and has a dovetail shaped slot 112 extending vertically therein, and a T-shaped slot 114 extending horizontally therein. From FIG. 22, it can be seen that guide 116 is slidably mounted in the T-shaped slot 114. As is best shown in FIG. 25, the guide 116 has a projection 118 with an opening 120 therein. From FIG. 22, it can be seen that the shaft 44 extends through the opening 120, which is filled by the shaft 44. In operation, the base 110 is slidable vertically on the anchor 108 while, simultaneously, the guide 116 can slide horizontally within the slot 114 of the base 110. Thus, the external mechanism 104 guides the shaft 44 in two directions, being the vertical and horizontal directions. When the shaft is said to move laterally in this specification, it shall be interpreted to mean laterally relative to a longitudinal axis of the shaft.

Figure 26:
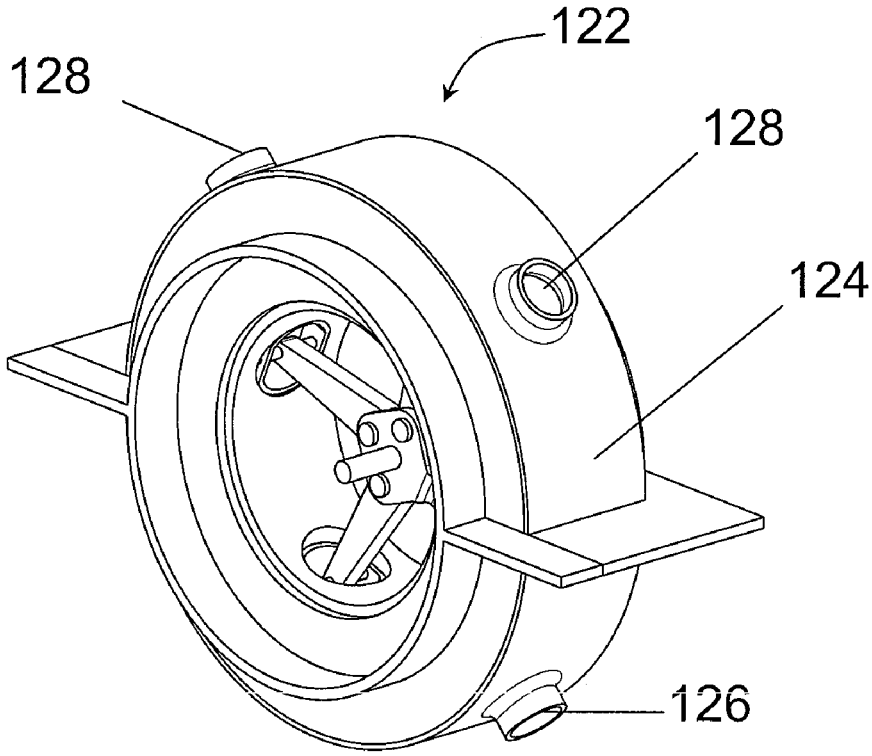
FIG. 26 is a perspective view of a pneumatic engine.
Figure 27:
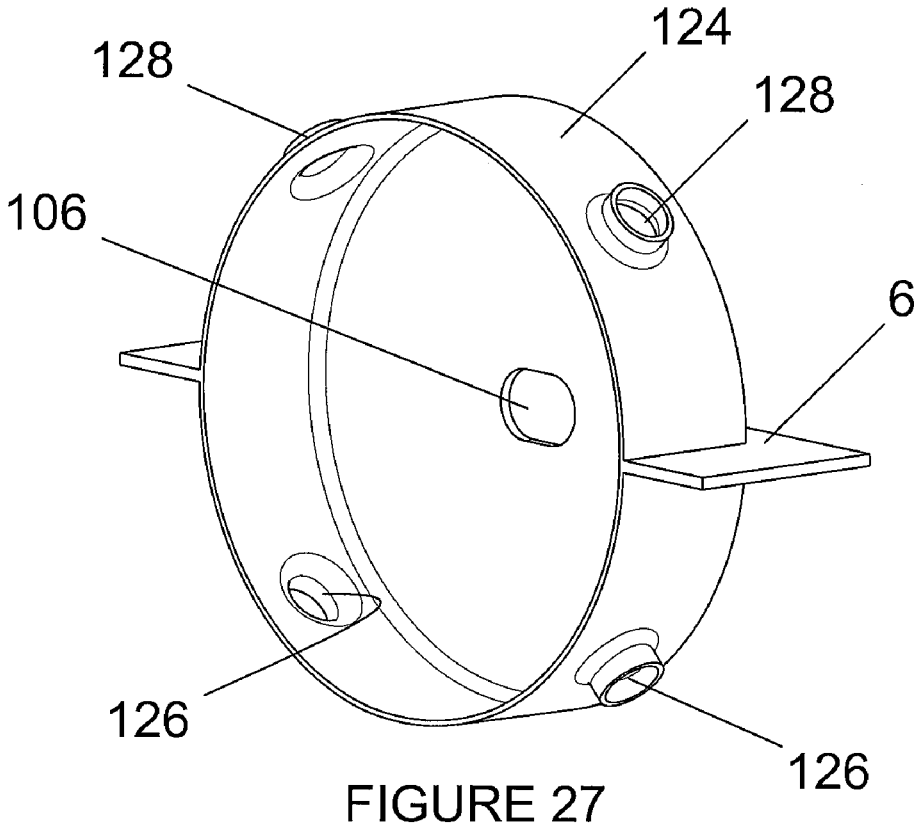
FIG. 27 is a perspective view of an engine block of the pneumatic engine.
Figure 28:
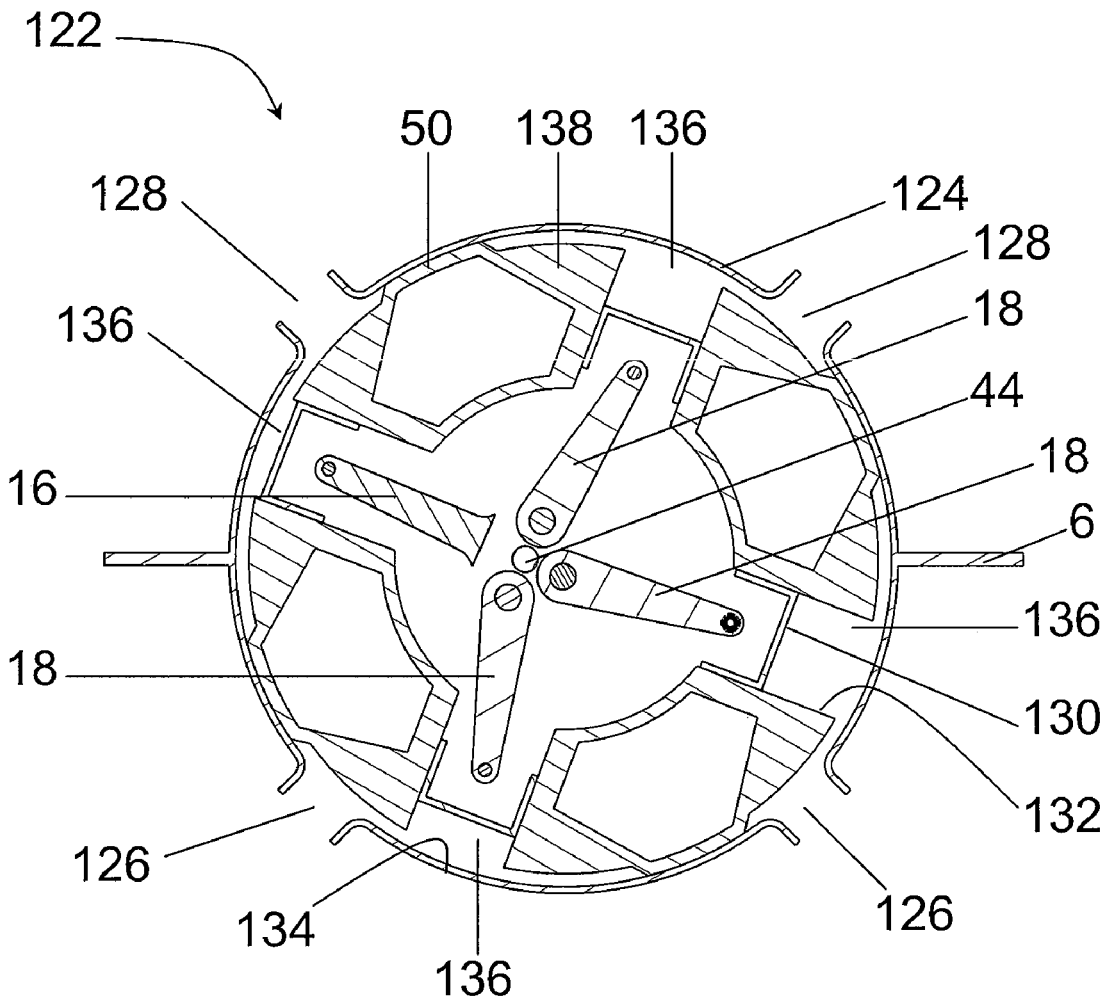
FIG. 28 is a cross-sectional view of the pneumatic engine shown in FIG. 26.

In FIGS. 26 to 28, a pneumatic engine 122 has an engine block 124 with fluid inlet ports 126 and fluid outlet ports 128. The engine 122 has four pistons, each piston being slidably mounted in a cylinder 132. The engine block 124 has an inner wall 134 and there are four chambers 136 each chamber being bounded by a piston 130, a cylinder 132 and an inner wall 134. The cylinders 132 are formed in a rotor 138 that rotates counterclockwise within the engine block 124. The rotor has pads 50 that slide along the inner wall 134 of the engine block 124. The pads 50 separate each of the chambers 136 from adjacent chambers. The same reference numerals are used in FIGS. 26 to 28 to describe those components that are identical to the components in FIGS. 1 to 25.

The pneumatic engine 122 is a radial engine that operates in a similar manner to the radial heat engine shown in FIGS. 1 to 21. In operation, the radial pneumatic engine 122 has inlet ports 126 connected to receive high pressured fluid. The high pressure fluid can be any suitable fluid, including air, water, and steam. The high pressure fluid (not shown in) causes the rotor 138 to rotate in the counterclockwise direction. As the rotor rotates, a chamber 136 that is filled with high pressure fluid from an inlet port 126 is closed off from the inlet port 126 and rotates adjacent to the outlet port 126 through which the fluid is exhausted from the chamber. The inlet openings 126 and the bottom half of the engine 122 are exposed to high pressure fluid and the outlet openings 128 and the top half of the engine are open to the atmosphere. The high pressure working fluid is exhausted through the outlet openings 128 as a low pressure fluid. There should be a sufficient number and placement of inlet ports and outlet ports along the bottom and top of the engine respectively to ensure that each chamber is always either being pressurized or is exhausting.

When a chamber is in the bottom of the pneumatic engine 122, the high pressure fluid pushes the piston in that chamber away from the outlet wall of the block, which causes a reaction forcing the piston assembly, which, in turn, produces power. When a chamber rotates into the top half of the engine, the fluid is allowed to escape through the outlet ports. Some of the power produced by the chambers along the bottom half of the engine is used to push the fluid out of the chambers in the top half of the engine. The stroke of the pistons can be adjusted by moving the pivot shaft toward or away from the center of the engine. As the pivot shaft is moved away from the center of the engine, the stroke is increased causing a larger displacement which decreases the engine speed, but increases torque (at a constant mass flow rate).

The heat engine is described with one engine block containing a rotor having four pistons. The heat engine can be expanded by having two or more engine blocks mounted immediately adjacent to one another, with each engine block containing a rotor and each rotor having a plurality of pistons therein. The timing of the plurality of pistons and rotors between different engine blocks can be set to achieve the desired characteristics of power output.

Various fluids and gases can be used as the working fluid. Preferably, the working fluid is selected from the group of air, helium, hydrogen, nitrogen, methane, ammonia, and water. Preferably, the slot is linear but the slot can be large enough to allow two degrees of adjustment. The two degrees of adjustment are preferably vertical and horizontal. The rotor can be made from piece or is made from several components welded together or it can be made as a sub-assembly. The type of heat source for the engine can be selected from a group of nuclear, solar, geothermal, water, air/wind, biomass, cellulose, and heat energy from waste. Preferably, the heating and cooling chambers are sealed with a seal along the interior circular wail of the engine block.

While the invention is preferably used as a rotary heat engine, alternatively, the device can be made to function as a heat pump. If the rotor is caused to rotate in a clockwise direction by, for example, an external energy source such as an electric motor, the lower chambers will be subject to a vacuum, which lowers the fluid temperature and pulls heat from the lower surface while the upper chambers are subjected to a compression which increases the fluid temperature and passes it to the upper surface. Therefore, if the upper surface is allowed to dissipate the heat produced through convection, conduction, radiation, or other means, the lower surface will always be cool relative to the upper surface. If the rotor is rotated by external energy in a counter clockwise direction, the lower chambers are subject to compression which increases the temperature while the upper chambers are subject to a vacuum which lowers the temperature. The advantage of the device is that the heat can be pumped in either direction as opposed to current air conditioning systems where heat can only be pumped in one direction. The device works the same with compression producing heat dissipation and expansion producing heat absorption as the pistons in the rotor move through a full cycle of three hundred and sixty degrees.

The heat engine can be made to be more efficient by adding more cylinders.

The invention claimed is:

1. A rotary heat engine comprising a cylindrical engine block having a longitudinal centre axis and containing a rotor having a plurality of equally spaced pistons and corresponding cylinders extending radially therein, said pistons being pivotally connected to connecting rods that are in turn pivotally connected to a shaft at an inner end of each connecting rod, said shaft extending through said engine block in a direction substantially parallel to said centre axis, said block containing a slot to allow said shaft to move laterally toward or away from said centre axis, said rotor being sized and shaped to rotate within said engine block in a plane perpendicular to said centre axis, said rotor having a plurality of heating and cooling chambers therein, there being one heating and cooling chamber for each piston, said heating and cooling chambers each including one of said corresponding cylinders, said pistons and said corresponding cylinders each being shaped so that said pistons slide radially within said cylinders, said engine block being heated at one or more locations and cooled at one or more alternate locations around a circumference of said block, said heated or cooled locations of said block cause heating or cooling of said chambers respectively within said rotor, said rotor containing a working fluid within said chambers, said pistons moving inward in response to a heated chamber and outward in response to a cooled chamber, a reciprocating movement of said pistons in succession causing said rotor to rotate within said block, said pistons and said chambers rotating with said rotor.

2. A heat engine as claimed in claim 1 wherein the shaft does not rotate and energy from the engine is harnessed from the movement of the rotor.

3. A heat engine as claimed in claim 1 wherein the shaft is allowed to rotate relative to the block and energy output from the engine drives the rotation of the shaft.

4. A heat engine as claimed in claim 1 wherein the heating and the cooling chambers are each bound by an inner surface of the engine block, a portion of the outer wall of the rotor and an outer portion of each piston.

5. A heat engine as claimed in claim 4 wherein there is insulation between the heating and cooling chambers on a circumference of the rotor.

6. A heat engine as claimed in claim 1 wherein the pistons are hollow with a U-shaped cross-section that opens toward an outer end.

7. A heat engine as claimed in claim 1 wherein the heating and cooling locations are fixed.

8. A heat engine as claimed in claim 6 wherein the rotor has four pistons, corresponding cylinders and corresponding chambers.

9. A heat engine as claimed in claim 7 wherein the heating and cooling locations on the block each extend for 180 degrees.

10. A heat engine as claimed in claim 8 wherein each piston has four successive stages, said stages being cooling, compression, heating and expansion.

11. A heat engine as claimed in claim 8 wherein there is one master connecting rod and three slave connecting rods.

12. A heat engine as claimed in claim 1 wherein the engine block has a cover thereon.

13. A heat engine as claimed in claim 1 wherein the working fluid is selected from the group of air, helium, hydrogen, nitrogen, methane and ammonia, and water.

14. A heat engine as claimed in claim 1 wherein the slot is linear.

15. A heat engine as claimed in claim 1 wherein the slot allows two degrees (vertical and horizontal) of adjustment.

16. A heat engine as claimed in claim 8 wherein the chambers consist only of an interior of the cylinders extending between an inner surface of the engine block and piston with a small space between each cylinder and an interior wall of the block.

17. A heat engine as claimed in claim 1 wherein the rotor is made from one piece or is made from several components welded together or as a sub-assembly.

18. A heat engine as claimed in claim 1 wherein a type of heat source for said engine is selected from the group of nuclear, solar, geothermal, body of water, and air/wind.

19. A heat engine as claimed in claim 1 wherein the heating and cooling chambers are sealed with a seal along an interior circular wall of said engine block.

20. A heat engine as claimed in claim 1 wherein the heating and cooling chambers are sealed with a seal around the perimeter of said rotor.

21. A heat engine as claimed in claim 1 wherein there is an external mechanism mounted on said block to guide said shaft in two directions.

22. A heat engine as claimed in claim 12 wherein said chambers are bounded by said piston, said block, said cover, and an outer circumference of said rotor in an area of said pistons.

23. A heat engine as claimed in claim 12 wherein said rotor is held within said block and cover by said block and cover.

24. A heat engine as claimed claim 23 wherein there is an external mechanism to support the position of said rotor.

25. A heat pump for heating or cooling, said heat pump comprising a cylindrical engine block having a longitudinal center axis and containing a rotor having a plurality of equally spaced pistons and corresponding cylinders extending radially within said rotor, said pistons being pivotally connected to connecting rods that are in turn pivotally connected to a shaft at an inner end of said connecting rod, said shaft extending through said engine block in a direction substantially parallel to said center axis, said engine block containing a slot to allow said shaft to move laterally toward or away from said center axis, said rotor being sized and shaped to rotate within said engine block in a plane perpendicular to said center axis, said rotor having a plurality of heating and cooling chambers therein, there being one heating and cooling chamber for each piston, said heating and cooling chambers each including one of said corresponding cylinders, said pistons and said corresponding cylinders each being shaped so that said pistons slide radially within said cylinders, said rotor being connected to an energy source to cause said rotor to rotate within said engine block, the rotation of said rotor in a clockwise direction causing a vacuum in a lower portion of said block and compression in an upper portion of said block, thereby cooling said lower portion and heating said upper portion, said pistons reciprocating as said rotor rotates within said engine block.

26. A pneumatic engine comprising a rotor having a plurality of equally spaced pistons in corresponding cylinders extending radially therein, said pistons being pivotally connected to connecting rods that are in turn pivotally connected to a shaft at an inner end of each connecting rod, said shaft extending through said engine block in a direction substantially parallel to said center axis, said block containing a slot to allow said shaft to move laterally toward or away from said center axis, said rotor being sized and shaped to rotate within said engine block in a plane perpendicular to said center axis, said rotor having a plurality of chambers therein, there being one chamber for each piston, said chambers each including one of said corresponding cylinders, said pistons and said corresponding cylinders each being shaped so that the pistons slide radially within the cylinders, said engine block having a plurality of inlet ports in one side thereof and a plurality of outlet ports in an opposite side thereof, said inlet ports being connected to allow high pressure fluid to enter those of said chambers that are adjacent to said inlet ports, said outlet ports being connected to exhaust said fluid from those of said chambers located adjacent to said outlet ports, said pistons moving inward in response to said high pressure fluid entering said chambers through said inlet ports and said pistons moving outward in response to said fluid being exhausted from said outlet ports, a reciprocating moving of said pistons in succession in response to said high pressure fluid moving through said chambers of said engine block causing said rotor to rotate within said block, said pistons and said chambers rotating with said rotor.

27. An energy conversion devise comprising a cylindrical block having a longitudinal center axis and containing a rotor having a plurality of equally spaced pistons and corresponding cylinders extending radially therein, said pistons being pivotally connected to connecting rods that are in turn pivotally connected to a shaft at an inner end of each connecting rod, said shaft extending through said block in a direction substantially parallel to said center axis, said block containing a slot to allow said shaft to move laterally toward or away from said center axis, said rotor being sized and shaped to rotate within said block in a plane perpendicular to said center axis, said rotor having a plurality of chambers therein, there being one chamber for each piston, said chambers each including one of said corresponding cylinders, said pistons and said corresponding cylinders each being shaped so that said pistons slide radially within said cylinders, said block being subjected to an energy input on one side of said block and an energy output on an opposite side of said block, said energy input entering said chambers that are located adjacent to said energy input side of said block and causing said pistons in those chambers to move inward in response to said energy input and causing said pistons in said chambers on an opposite side of said block to move outward in response to energy output from said block, a reciprocating movement of said pistons in succession causing said rotor to rotate within said block, said pistons and said chambers rotating with said rotor.

* * * * *